United States Patent [19]

Cyrot

[11] 4,351,226

[45] Sep. 28, 1982

[54] FLUID CONTROL SYSTEM

[75] Inventor: Luc P. Cyrot, Mission Viejo, Calif.

[73] Assignee: Parker-Hannifin Corporation, Cleveland, Ohio

[21] Appl. No.: 153,363

[22] Filed: May 27, 1980

[51] Int. Cl.[3] ..... F15B 13/16

[52] U.S. Cl. ..... 91/387; 92/131

[58] Field of Search ..... 91/387, 374; 92/130 R, 92/131

[56] References Cited

U.S. PATENT DOCUMENTS 1,669,108 5/1928 Warner ..... 91/374

4,138,088 2/1979 Cyrot ..... 92/146

FOREIGN PATENT DOCUMENTS 476341 12/1937 United Kingdom ..... 91/387

*Primary Examiner*—Paul E. Maslousky

*Attorney, Agent, or Firm*—James A. Baker; Frederick L. Tolhurst

[57] ABSTRACT

A fluid control system includes a fluid motor 11, a control valve 12 for directing fluid flow to and from the motor 11, and a control valve actuator 14 for operating the control valve 12. The control valve actuator 14 includes an actuator member 32, a feedback member 44, and a spring 46 which exerts a force on the actuator member 32 whose magnitude varies with the relative positions of the actuator member 32 and the feedback member 44. A command pressure signal moves the actuator member 32 to operate the control valve 12 in order to direct fluid flow to and from the fluid motor 11. A feedback link 41 connects the feedback member 44 to the fluid motor 11. The actuator piston 32 is slidably carried on the feedback member 44, so that any drifting of the fluid motor 11 results in immediate movement of the actuator member 32 and control valve 12 to correct the drifting.

9 Claims, 1 Drawing Figure

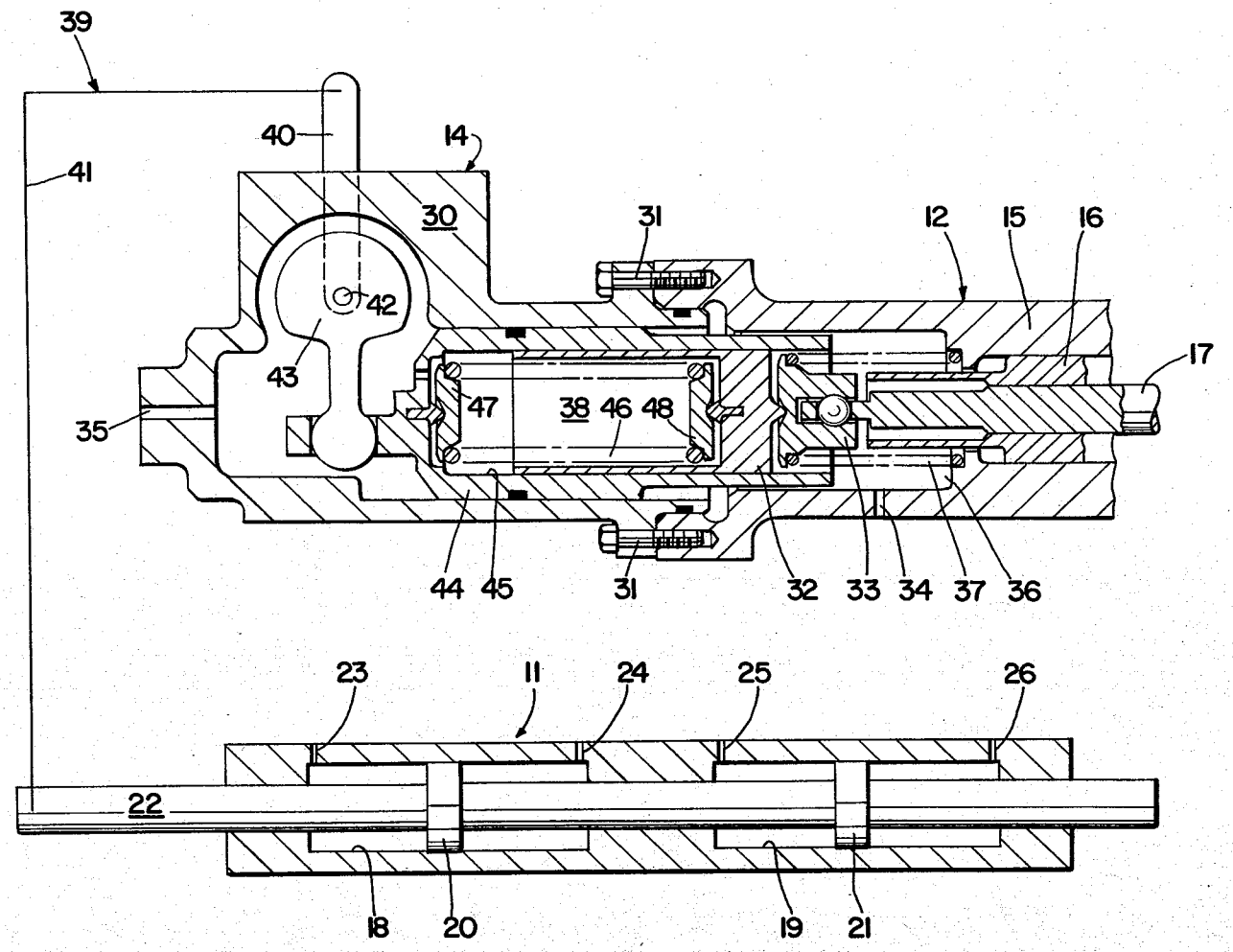
17
16
15
12
36
37
34
33
32
31
31
48
46
38
47
45
44
14
30
42
43
40
39
41
35
26
21
19
25
24
11
20
18
23
22

FLUID CONTROL SYSTEM

BACKGROUND OF THE INVENTION

This invention relates generally to a fluid control for a hydraulic motor, and more particularly to a fluid control that is useful as a redundant or backup control for an aircraft electro-hydraulic system.

In an aircraft electro-hydraulic system, an electrical signal originating at a command station is transmitted to an electro-hydraulic servo valve. The electro-hydraulic servo valve controls a primary valve that directs the flow of fluid to and from a fluid motor. The fluid motor, in turn, actuates a flight control surface such as a rudder or aileron of the aircraft. In the event of a failure in the electro-hydraulic system, a mechanically controlled backup valve directs the flow of fluid to and from the fluid motor to provide backup actuation of the flight control surface.

One such aircraft electro-hydraulic system is disclosed in U.S. Pat. No. 4,138,088, the entirety of which is incorporated herein by reference.

SUMMARY OF THE INVENTION

The present invention provides a fluid control system that is particularly useful for replacing the mechanical backup system discussed above in an aircraft electro-hydraulic system. The invention is characterized by extremely stable drift free operation of the fluid motor by the backup system.

In a preferred embodiment of the invention, a backup control valve spool is provided for directing backup flow to and from the fluid motor. A control valve actuator piston is arranged to move the spool in response to a backup command fluid pressure differential imposed on opposite sides of the piston. A feedback linkage mechanically connected to the fluid motor includes a hollow canister in which the actuator piston is slidably disposed.

By this arrangement, any drifing of the fluid motor causes immediate movement of the canister, the actuator piston, and the backup control valve spool. This causes the spool to supply backup flow to the fluid motor to correct the drifing, without delays created by frictional forces between the actuator piston and the bore in which the actuator piston is disposed. When the force unbalance on opposite sides of the actuator piston is sufficiently great to overcome the frictional forces between the actuator piston and the bore in which the actuator piston is disposed, the actuator piston moves relative to the canister to continue to operate the spool to compensate for the drifing. After the drifing has been corrected, the actuator piston returns the spool to its equilibrium position in which flow to the fluid motor is terminated.

BRIEF DESCRIPTION OF THE DRAWING

These and other aspects and advantages of the invention are incorporated in the preferred embodiment of the invention shown in the drawing, which is a cross-sectional side-elevational view of a control valve actuator and a schematic representation of a system in which the control valve actuator may be used.

DETAILED DESCRIPTION OF THE DRAWING

Referring now to the drawing in greater detail, a fluid control system includes a fluid motor 11, a control valve 12 for directing fluid flow to and from the fluid motor

11, and a control valve actuator 14 for operating the control valve 12.

The fluid motor 11 is a redundant fluid motor having cylinders 18 and 19 in which pistons 20 and 21 are slidably disposed. A piston rod 22 is connected to the pistons 20 and 21 to actuate a flight control surface (not shown) of an aircraft. Fluid motor ports 23, 24, 25 and 26 are connected to the control valve 12 by suitable hydraulic lines (not shown) to direct hydraulic fluid to and from the cylinders 18 and 19 when the control valve 12 is displaced from its neutral or equilibrium position.

The control valve 12 includes a housing 15, a stationary sleeve 16, and a valve spool 17. The spool 17 is slidably disposed in the sleeve 16, and the spool 17 has a plurality of lands and grooves (not shown) which in a well-known manner direct fluid flow to and from the fluid motor 11. For example, the lands and grooves of the spool 17 may be arranged in the same manner as the lands and grooves of the mechanically actuated spool 31 shown in the above referenced U.S. Pat. No. 4,138,088.

The control valve actuator 14 includes a housing 30 which is secured to the control valve housing 15 by bolts 31. An actuator piston 32 is slidably disposed in the housing 30 to operate the valve spool 17. A universal link 33 is arranged between the spool 17 and the actuator piston 32 to insure that only forces in the longitudinal direction are transmitted therebetween. The ball link 33 utilizes a cup-shaped member and a ball to eliminate the transmission of any forces in a radial direction for this purpose. A spring 37 acts between the housing 15 and the link 33 to retain the link 33 against the actuator piston 32 under all conditions.

The housing portions 15 and 30 are preferably cast aluminum and are provided with fluid ports 34 and 35 communicating with fluid pressure chambers 36 and 38 on opposite sides of the actuator piston 32. The ports 34 and 35 establish a pressure differential across the actuator piston 32 by receiving a command signal to displace the piston 32. This displacement of the piston 32 operates the spool 17 to control the fluid motor 11, in a manner described below.

The control valve actuator 14 also includes feedback linkage 39 between the fluid motor 11 and the actuator piston 32. The feedback linkage senses the position of the fluid motor 11 and communicates a mechanical feedback signal to the actuator piston 32 which is proportional to that position. This provides a closed loop system in which a command signal indicating a desired position of the fluid motor 11 is communicated by the ports 34 and 35 to the piston 32, and in which the piston 32 returns the spool 17 to its neutral position to stop further movement of the fluid motor 11 when the fluid motor 11 has reached the desired position.

The feedback linkage 39 includes an external arm 40 which is mechanically connected to the piston rod 22 of the fluid motor 11 by a suitable mechanical link 41. The arm 40 is disposed on the exterior of the housing 30 and is connected by a transverse pin 42 to an internal arm 43. The pin 42 pivotally connects the arms 40 and 43 to the housing 30, so that pivotal movement of the arm 40 causes corresponding pivotal movement of the arm 43.

The feedback linkage 39 shown in the drawing also includes a canister 44. The canister 44 is a hollow, cylindrical, cup-shaped member which is slidably disposed in the housing 30 and which is connected to the bottom end of the arm 43 so that pivotal movement of the arm 43 causes reciprocating longitudinal movement of the canister 44. The canister 44 includes a bore 45 in which the actuator piston 32 is slidably disposed. A feedback spring 46 is also carried by the canister 44. The spring 46 is a compression spring acting between the canister 44 and the actuator piston 32 through suitable links 47 and 48 which assure that forces between the canister 44 and the actuator piston 32 are transmitted only in the longitudinal direction.

The positions of the valve spool 17 and actuator piston 32 shown in the drawing are equilibrium positions. In these equilibrium positions, the spool 17 blocks all flow of fluid (except leakage flow) to and from the motor 11. Additionally, the force of the springs 37 and 46 balance one another, and the pressure differential provided by the ports 34 and 35 across the actuator spool 32 is nil. For purposes of this description, it can be assumed that the force of the spring 37 is always fifty pounds, because the spool 17 and link 33 move only very small longitudinal distances relative to the housing 15. However, the force of the spring 46 varies from ten pounds to one hundred pounds when the relative positions of the canister 44 and actuator piston 32 are changed from the positions shown in the drawing, as explained in further detail below.

When the position of the fluid motor 11 is to be changed, the ports 34 and 35 establish a predetermined pressure differential between the chambers 36 and 38, and hence across the actuator piston 32. This pressure differential can be created by a fluidic computer (not shown) or by any other available source of fluid pressure. For purposes of this example, it will be assumed that the pressure differential is such that the pressure in the chamber 36 on the right side of the actuator piston 32 is lower than the pressure in the chamber 38 on the left side of the actuator piston 32. This creates a force unbalance on the actuator piston 32 and causes the actuator piston 32 to move the valve spool 17 to the right. This righward movement of the spool 17 directs fluid flow to the ports 23 and 25 and from the ports 24 and 26 to cause the rod 22 to move to the right. This pivots the external arm 40 and the internal arm 43 clockwise as viewed in the drawing to move the canister 44 to the left relative to the piston 32. The leftward movement of the canister 44 decreases the bias of the spring 46 and permits the actuator piston 32 to move back to the left to its equilibrium position shown in the drawing, so that the valve spool 17 returns to its equilibrium position to terminate flow to and from the fluid motor 11 when the fluid motor 11 has reached the position dictated by the pressure differential between the ports 34 and 35. In this new equilibrium position, the internal arm 43 will be rotated clockwise from the position shown in the drawing, and the force of the spring 46 will be less than the fifty pound force of the spring 37 to balance the imposed pressure differential across the piston 32.

In the event the fluid motor 11 begins to drift to the right from the position dictated by the pressure differential across the piston 32, the spool 17 will immediately be displaced from its equilibrium position to compensate for this drifting, without delays caused by frictional forces. This is because such rightward drifting of the fluid motor 11 causes clockwise pivotal movement of the arms 40 and 43, which results in leftward displacement of the canister 44. Because the piston 32 is carried by the canister 44, the piston 32 is displaced to the left with the canister 44 to move the spool 17 to the left.

The leftward movement of the spool 17 directs fluid flow to the ports 24 and 26 and from the ports 23 and 25 to begin moving the rod 22 to the left to compensate for the rightward drift. This rotates the arms 40 and 43 counter-clockwise as viewed in the drawing to increase the force of the spring 46 on the piston 32, and permits the piston 32 and spool 17 to return to their equilibrium positions.

When the fluid control shown in the drawing is to be used as a backup control for the electro-hydraulic system shown in the above referenced U.S. Pat. No.4,138,088, the mechanical backup linkage for actuating the mechanical backup valve 31 in U.S. Pat. No. 4,138,088 is eliminated and is replaced by ther fluid control system shown herein. Additionally, the fluid control system shown herein can be used as a backup control system or as a primary control system in a wide variety of other fluid power systems.

What is claimed is:

1. A fluid control system that includes, a fluid motor, a control valve, and a control valve actuator, said control valve actuator comprising:

an actuator member;

means on said actuator member responsive to a command signal for moving said actuator member with respect to an equilibrium position;

means for mechanically connecting said actuator member to said control valve;

a feedback member that slidably supports and carries said actuating member;

means for mechanically connecting said feedback member to said fluid motor; and spring means acting between said actuator member and said feedback member and exerting a force on said actuator member whose magnitude varies with the distance between said actuator member and said feedback member, said spring means being responsive to the movement of said actuator member and to the movement of said feedback member to return the actuator member to its equilibrium position.

2. A fluid control system as set forth in claim 1, including means on said feedback member for carrying said spring means.

3. A fluid control system as set forth in claim 1, wherein said feedback member includes a cavity for supporting and carrying said actuator means.

4. A fluid control system having a control valve, a fluid motor, and a control valve actuator, said control valve actuator comprising:

an actuator piston;

means mechanically connecting said actuator piston and said control valve;

means for supplying a fluid pressure signal to said actuator piston to move the actuator piston with respect to an equilibrium position;

a mechanical feedback link that slidably carries said actuator piston;

means for connecting said feedback link with said fluid motor; and spring means that is carried by said feedback link and that acts between said feedback link and said actuator piston and that is responsive to the movement of said actuator piston and to the movement of said feedback link to return the actuator member to its equilibrium position.

5. A control valve actuator as set forth in claim 4, including link means for transmitting forces between said feedback link and said spring means and between said actuator piston and said spring means solely in the longitudinal direction .

6. A fluid control system having a control valve spool, a fluid motor, and a control valve spool actuator, said control valve spool actuator comprising:

an actuator piston;

means to mechanically connect said actuator piston and said control valve spool;

a fluid pressure chamber on each side of said actuator piston for moving the actuator piston with respect to an equilibrium position;

passage means in communication with each of said chambers;

a feedback link having a cavity with said actuator piston, slidably disposed therein;

means connecting said feedback link with said fluid motor such that the position of said feedback link is dependent upon the position of said fluid motor; and spring means acting between said feedback link and said actuator piston and that is responsive to the movement of said actuator piston and to the movement of said feedback link to return the actuator member to the equilibrium position.

7. A control valve actuator as set forth in claim 6, wherein one of said fluid chambers is defined by said cavity and said actuator piston.

8. A control valve actuator as set forth in claim 7 wherein said feedback link includes a generally cup-shaped member having a longitudinal bore that defines said cavity.

9. A control valve actuator as set forth in claim 8, wherein said cup-shaped member includes a bottom surface, and said spring means acts between said bottom surface and said actuator piston.

* * * * *